US007832149B2

(12) United States Patent
Ligas, Jr. et al.

(10) Patent No.: US 7,832,149 B2
(45) Date of Patent: Nov. 16, 2010

(54) PERIMETER WALL PANELS FOR AN AIR SUPPORTED STRUCTURE

(75) Inventors: Jan Ligas, Jr., Montvale, NJ (US); Nicholai Gomozov, Moscow (RU)

(73) Assignee: Johnson Heater Corp., St. Louis, MO (US)

( * ) Notice: Subject to any disclaimer, the term of this patent is extended or adjusted under 35 U.S.C. 154(b) by 571 days.

(21) Appl. No.: 11/860,796

(22) Filed: Sep. 25, 2007

(65) Prior Publication Data

US 2008/0072501 A1 Mar. 27, 2008

Related U.S. Application Data

(60) Provisional application No. 60/826,760, filed on Sep. 25, 2006.

(30) Foreign Application Priority Data

Dec. 11, 2006 (RU) ..... 2006143779

(51) Int. Cl.
*E04G 11/04* (2006.01)

(52) U.S. Cl. ..... 52/2.25; 52/83; 52/2.11; 52/3; 52/2.19; 52/2.24; 135/119; 135/908

(58) Field of Classification Search ..... 52/2.25, 52/83, 2.11, 2.19, 2.24, 3, 5, 23, 63, 506.1; 135/119, 908
See application file for complete search history.

(56) References Cited

U.S. PATENT DOCUMENTS

| | | | |
|---|---|---|---|
| 2,024,056 | A | 12/1935 | Morison |
| 2,751,635 | A | 6/1956 | Donnahue |
| 3,189,949 | A | 6/1965 | Hurkamp |
| 3,389,510 | A | 6/1968 | Stock |
| 4,305,235 | A | 12/1981 | Roston |
| 4,633,626 | A | 1/1987 | Freeman et al. |

OTHER PUBLICATIONS

International Search Report, International Patent Application No. PCT/US07/79373, mailed on Apr. 11, 2008.

*Primary Examiner*—Richard E Chilcot, Jr.
*Assistant Examiner*—Mark R Wendell
(74) *Attorney, Agent, or Firm*—Lewis, Rice & Fingersh, L.C.

(57) ABSTRACT

A wall panel which can be used to provide a lower, more rigid, perimeter wall to an air supported structure. The wall panels may be attached to the earth via a hinged connection to provide for improved ease of raising the air supported structure and to allow for flexing, or may be rigidly attached. The wall panels will generally be modular and interchangeable.

9 Claims, 18 Drawing Sheets

PERIMETER WALL PANELS FOR AN AIR SUPPORTED STRUCTURE

CROSS REFERENCE TO RELATED APPLICATION(S)

This application claims the benefit of U.S. provisional Application Ser. No. 60/826,760, filed Sep. 25, 2006 and currently pending and claims priority to Russian Application 2006143779 filed Dec. 11, 2006 and currently pending. The entire disclosure of both the above documents is herein incorporated by reference.

BACKGROUND

1. Field of the Invention

The invention relates to panels which can be used as a lower section of an air supported structure, structures constructed with such panels, and methods for constructing such structures.

2. Description of the Related Art

Air supported structures are becoming increasingly common as they can allow for construction of buildings, particularly those requiring a large, clear span of space, at a significantly reduced cost and in a fraction of the installation time. Such buildings need not be temporary and recent improvements in their design and construction have made them capable of operating year round, in a multitude of environments and over extended periods of time which are comparable to conventional construction techniques for brick and mortar or glass and steel buildings.

Previously, an air supported structure has been a structure that essentially only uses a large sheet or membrane as its building material. This material is anchored to the ground and, in its simplest form, is filled with air. The air which is provided to the structure provides it with a positive pressure which is sufficient to result in the structure essentially inflating relative to the ground and therefore providing an enclosed area inside the bubble or dome that is enclosed by the membrane. So long as the air pressure is maintained, the structure will remain upright and can be used in the same way as any other structure. Air supported structures, because they can provide for vast expanses of enclosed space without need for roof support columns or pillars, can provide for particularly useful enclosed areas for buildings which require a large, open expanse such as warehouses, covers for athletic fields, classrooms, auditoriums, schools, gymnasiums and similar structures. Further, by its very nature, the structure of an air structure is often more sturdy than a conventional building of similar size.

Air supported structures, however, can also have downsides. While the structure can include a number of more rigidly designed components to provide for doors, garages, air locks and other components which more conventional structures include, the structure is still necessarily that of a large, inflated membrane. This results in a particular appearance and vulnerability from the exterior which is often undesirable. Further, the structure can be vulnerable to vandalism, breach of the interior through the exterior, breach of the exterior from the interior, or other breach from the exterior or interior from those who may penetrate, cut or otherwise breach the structure seeking to gain access, deface, penetrate or simply cause damage, either accidentally or intentionally. This will generally not result in major damage or collapse of the structure, but can lead to an undesirable appearance, a breach of safety of the structure, or another breach of the space exterior or interior to the structure. Further, many potential consumers, users or others with an interest in the appearance, safety, installation or use of an air supported structure see the potential for vandalism, fire, accident or other destructive occurrences as a likely cause of the building's damage, destruction or collapse. While this is usually only a remote possibility, it can lead to selection of more conventional metal, brick and mortar, glass and steel or other structures instead of air structures due to considerations of safety, protection, appearance, aesthetics, function or in general the impression.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Described herein, among other things, are wall panels which can be used with an air supported structure to give the structure an improved or architecturally pleasing appearance, and to make it harder for any person, casualty or other event caused by a vandal, an accident (whether by nature or otherwise) itself to be able to deface, breach, damage enter, exit or access the fabric structure of an air supported building. These panels are not intended to completely prevent vandalism, accidents or casualty, or to provided improved appearance, but are intended to provide for a structure which has as its lower section an architecturally improved appearance and/or a safer, secure or more rigid design which raises the fabric membrane higher into the air and ideally more out of breach or reach of accident, a casualty, a human being or any other thing on the ground. Further, the wall panels may be modular and potentially reusable. In this way when the air supported structure is removed, the panels can be removed and reused on alternative structures. Further, if one was to be breached or damaged in any way, the panel can simply be repaired or replaced by another modular panel.

There is described herein, amongst other things, a wall panel for use with an inflatable structure, the wall panel comprising; a frame; two exterior panels attached to the frame and spaced from each other; an insulative inner section located between two of the exterior panels; a first connector, the first connector allowing the wall panel to be connected to the earth; a second connector, the second connector allowing the wall panel to be connected to a membrane; wherein, a plurality of the wall panels are used to form a perimeter wall on the lower portion of an air supported structure, the membrane forming a roof of the air supported structure.

In an embodiment of the panel the first connector is designed to attach to the earth via a foundation either in a hinged fashion which may use a common rod or individual bolts for each panel or in a rigid fashion.

In an embodiment, each of the exterior panels comprises a component panel, the structure may further include exterior cable nets encapsulating the structure.

There is further discussed here an inflatable structure which utilizes wall panels of any of the above discussed types to form a lower perimeter wall of the structure, and methods for constructing an inflatable structure which includes such a perimeter wall. In such a structure, the panels may be used as a fire break.

DESCRIPTION OF THE PREFERRED EMBODIMENT(S)

Figure 1A:
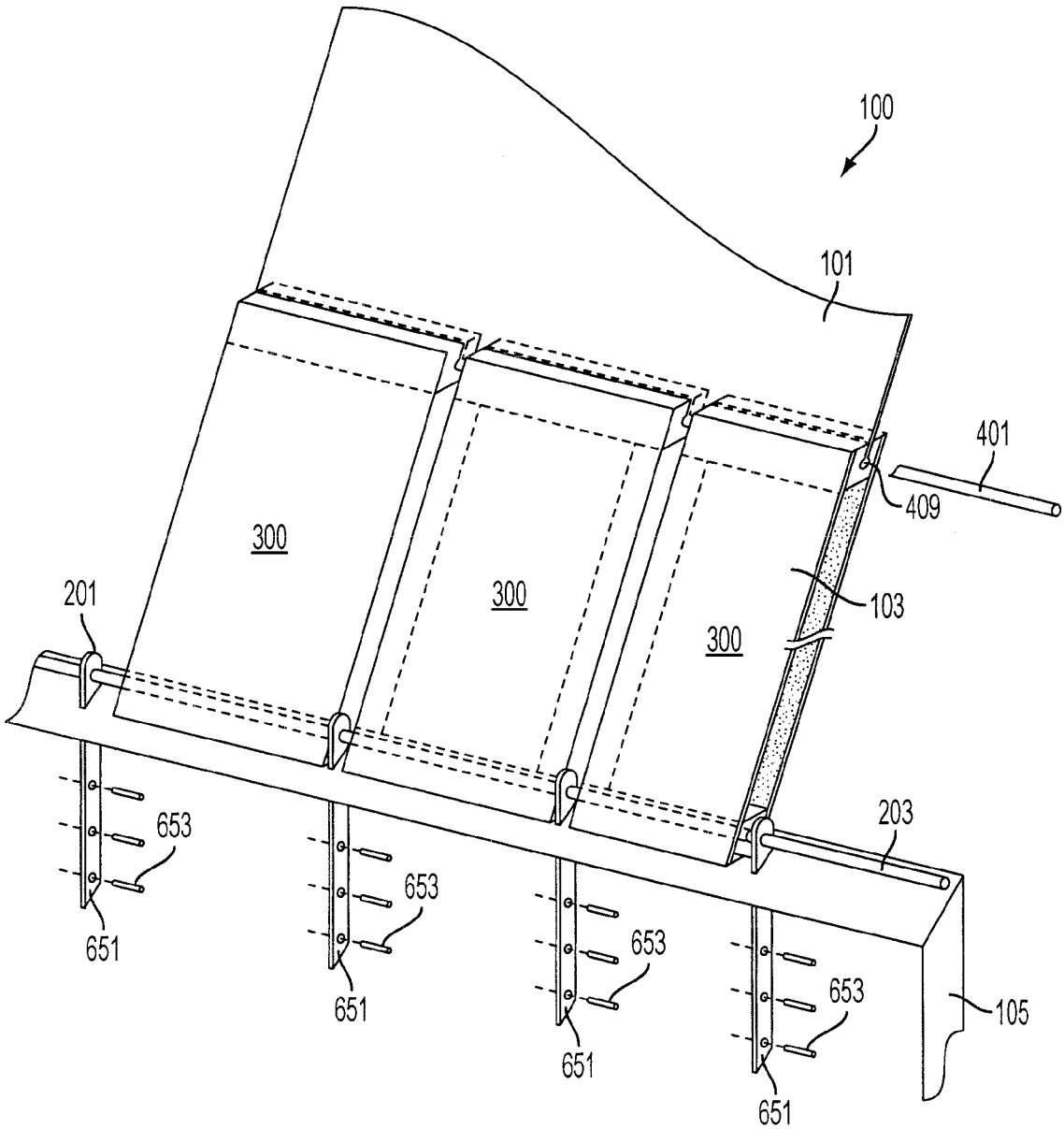
FIGS. 1A and 1B provides for perspective views of two embodiments of an air supported structure including perimeter wall panels which utilize different anchorages.

The following detailed description illustrates by way of example and not by way of limitation. The figures provided herewith show a number of wall panels and methods for allowing wall panels to be utilized as the lower portion of an air supported structure. While these embodiments all demonstrate systems and methods for constructing a lower perimeter wall for an air supported structure from a series of panels, they are intended to only provide exemplary embodiments, and are not the only methods and systems which can be used. This disclosure, therefore, should not be taken as being limited to them.

Generally, the embodiments of wall panels shown in the FIGS. are used to form a lower perimeter wall which usually has the appearance of a unitary structure of conventional construction formed from a number of the wall panels which are connected together. The lower perimeter wall serves to form the portion of the air supported structure closest to the ground and provides for a more rigid lower structure and structure of more conventional construction to an otherwise air supported building. The upper portion of the structure comprises a membrane of traditional form of an air supported structure as understood by those of ordinary skill in the art.

Generally, the wall panels forming the lower perimeter wall will be used to provide for a more rigid lower perimeter to the air supported building. This can improve aesthetics of the building by making it appear to be of a more traditional construction when viewed from the ground. Further, in many instances, the lower portion of buildings are often used as a place to post posters or placards, or to otherwise provide a pleasing architectural appearance, and the more rigid structure of the lower perimeter wall can make it more aesthetic for such purpose or posting, and make it easier to change or modify from time to time, or to remove such posters to further improve appearance.

The lower perimeter wall can also provide for safety and piece of mind for those concerned about breach, fire or potential damage to air supported structures resulting in total or partial destruction of the structure or creation of holes in the air supported structure. In particular, a more rigid lower perimeter wall can provide for a structure which is more resilient and resistive to fire or breach, or to being cut or otherwise being damaged by a vandal, any other third party, a force of nature, accident or by a casualty. Further, to meet certain fire codes, or simply for safety or piece of mind, the panels constituting the lower structure may be made of fire proofed, resistive or retardant materials or otherwise be fire proofed to delay or prevent flames from touching the membrane portions in most circumstances. While most air supported structures are manufactured with membranes which do not burn or are otherwise non-combustible, or will only char, this can enhance safety and eliminate concerns of fire spreading into or out of the structure at ground level by acting as a firewall or otherwise serving as a fire break. The lower section may also provide for more traditional insulation in the structure.

There are generally described herein two different types of perimeter walls. In the first type as shown in FIGS. 1-11, the perimeter wall is hinged to the ground. This can provide for an assembly where the wall can be put into place simply by inflation of the membrane in normal fashion and provide for a more flexible, modular construction. In the second type of construction as indicated by FIGS. 12-15, the perimeter wall is rigidly mounted to the ground, which can be more sturdy, but more complex to construct and may be harder to repair if sections are damaged. In either type of construction, the perimeter wall is generally comprised of a series of wall panels which are attached together to form the perimeter wall.

FIGS. 1-5 provide for a first embodiment of a hinged type of construction. In this embodiment the membrane (101) is attached to the top of the perimeter wall (103) which is then attached to the foundation (105) at its bottom. The perimeter wall (103) will effectively form an enclosing ring forming the base of the structure (100) although only a portion of the structure (100) is shown here.

Figure 4A:
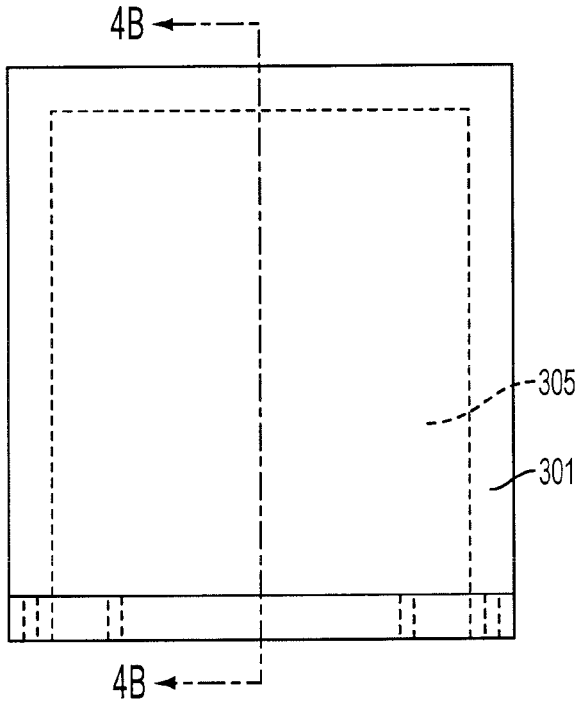
FIG. 4 provides for images of a wall panel of an embodiment.

In this embodiment, the perimeter wall (103) is formed of a series of wall panels (300) which are modular and interchangeable. Details of these wall panels (300) are shown in FIGS. 2 and 4. Each of the wall panels (300) is generally formed of an enclosing frame (301) as shown in FIG. 4A. The center of the flame is filled with an insulative material (303) such as, but not limited to, fibrous compounds, foams, or air.

Figure 4B:
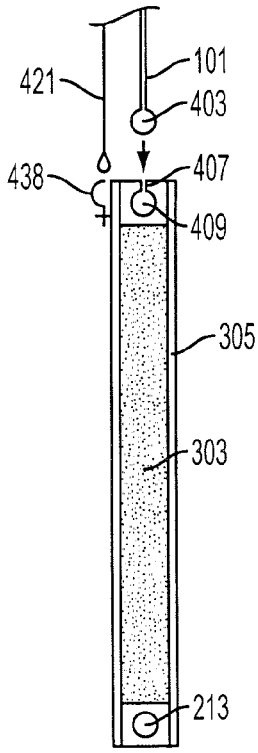

There is then placed on either side of the frame a cover layer (305). The cover layer (305) may be steel, plastic, wood, aluminum, or other relatively rigid materials, particularly those that are fairly common in conventional structures. This results in a type of sandwiched panel providing both insulation and fairly rigid construction on accessible surfaces. While a sandwiched insulative structure in the wall panel (300) as shown in FIGS. 4A and 4B is generally preferred, it is by no means required and in alternative embodiments, the wall panel (300) may be solid or hollow.

Each wall panel (300) is generally anchored to the ground via an anchorage (201) which is used to connect the panel to the foundation (105). The foundation (105), in its simplest embodiment, is simply packed earth. However, in other embodiments the foundation (105) may be designed to improve the attachment of the structure to the ground and may include cast concrete or similar materials. In the embodiments of FIGS. 1 through 11, the anchorage (201) is generally arranged as a hinged connection to the wall panels (300). Such a hinged connection is generally preferred as it allows the wall panels (300) to have some ability to move relative to the ground. This can be particularly beneficial as air supported structures (100) are often designed to flex in the wind. Further, it can provide for easier assembly where inflation of the structure (100) serves to perform on its own the lifting and support of the perimeter wall (103). It is, however, not required that the anchorage (201) be hinged to the wall panels (300) and the embodiments of FIGS. 12-15 provide for alternative designs which are rigidly connected to the foundation (105) or other material underlying the structure (100).

In such a hinged embodiment, if the air structure (100) were to flex toward one side or the other, the wall panels (300) would be able to adjust by rotating about their hinges. Further, the hinged connection allows for the wall panels (300) to be used with a variety of differently sized, dimensioned, or inflated pressure structures as they can adjust their final position depending on the resultant structure (100) shape. Further, hinged wall panels (300) can be raised with the inflation of the fabric portion of the structure (100) as they may be positioned at a variety of different angles during construction and inflation of the air supported structure.

In the embodiment of FIGS. 1 through 11 the hinging is generally accomplished by having a series of anchorages (201) in the foundation (105) which are capable of having a rod (203) or bolt (205) placed therethrough. A single rod (203) is used in the embodiment of FIGS. 1 through 5 for all wall panels (300) on a single linear side of the structure (100) to connect the wall panels (300) to the anchorage (201). This allows all the wall panels (300) to essentially be affixed together adjacent to each other. This rod (203) is threaded through holes (213) in the lower portion of each frame (301), placing the rod (203) internal to the wall panels (300), and through the anchor points (201) which are generally located between successive wall panels (300).

In the depicted embodiment of FIGS. 1 through 5, the rod (203) is a single piece which extends the entire length of a linear side of the structure (100), however, this is not necessary and multiple separate rods or bolts (205) may be used in an alternative embodiment. Such an embodiment is shown in FIGS. 6 through 8 where each frame (311) is comprised of a series of C-beams (321) and/or box beams (323). Adjacent wall panels (3000) are then bolted to the anchorage (201) using bolts (205) as shown in FIG. 8B. Other points of connection between adjacent wall panels (3000) may also be connected with bolts (205) and spacers (207) as shown in FIG. 8A.

Figure 6:
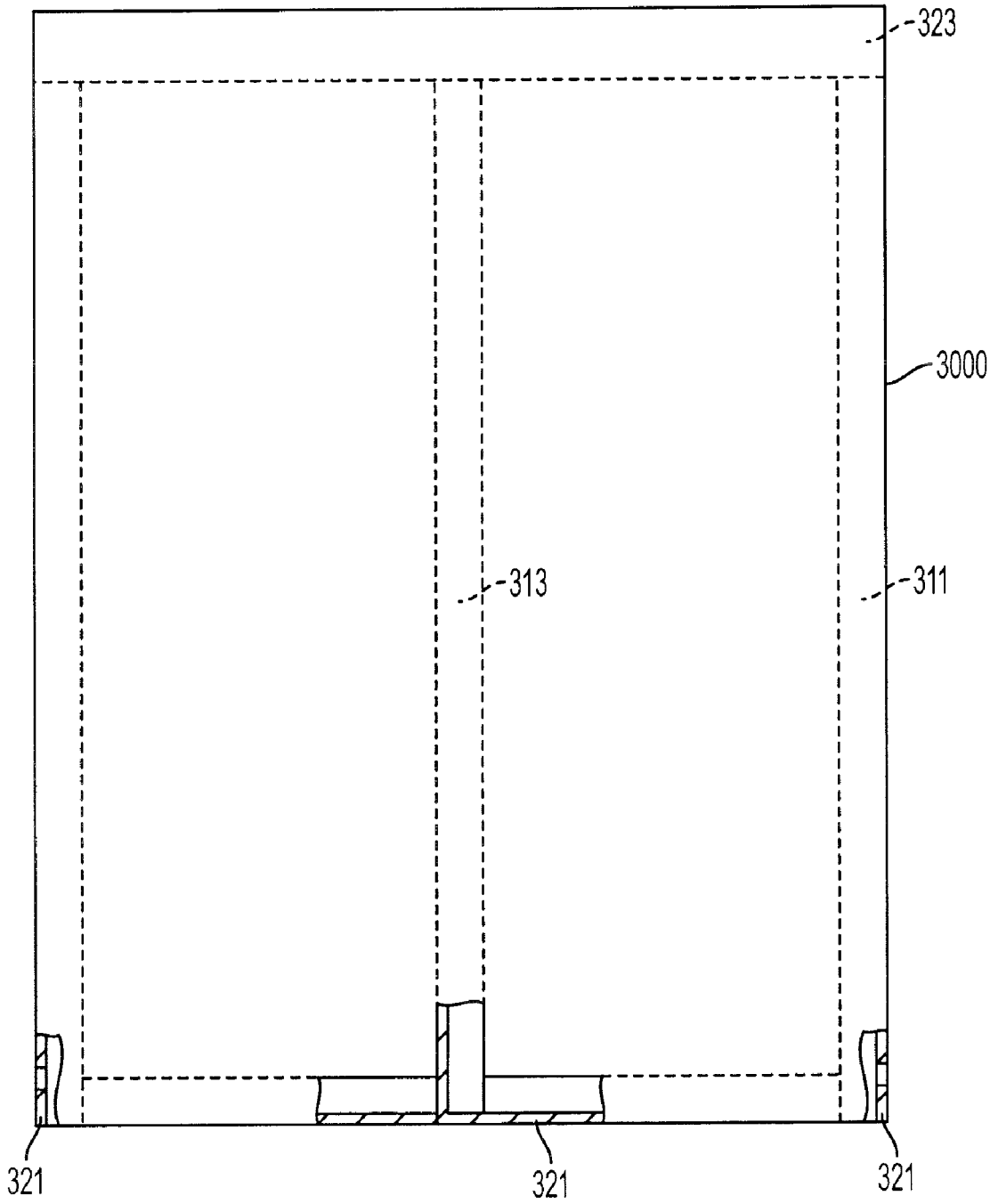
FIG. 6 shows a plan view of the internal frame structure of an embodiment of a wall panel with some cutaway sections.
Figure 7A:
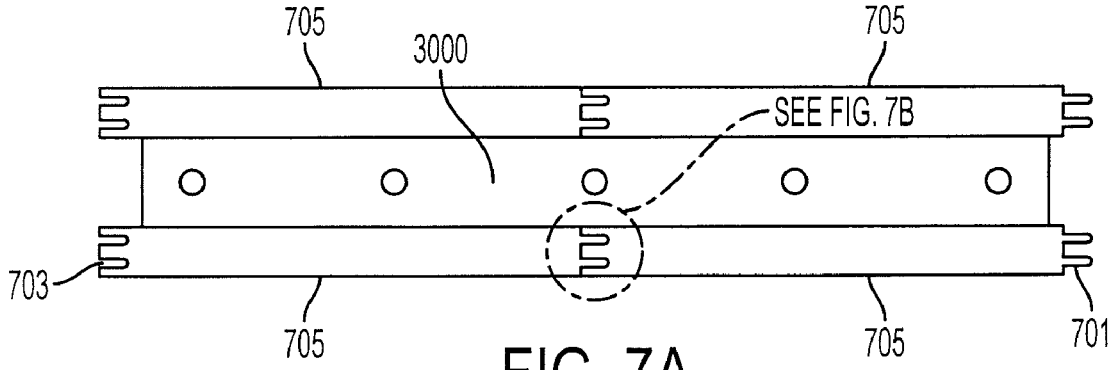
FIG. 7 shows a detail view of an embodiment of a connection for connecting outer sandwich panels to the frame of FIG. 6 when forming a wall panel.
Figure 7B:
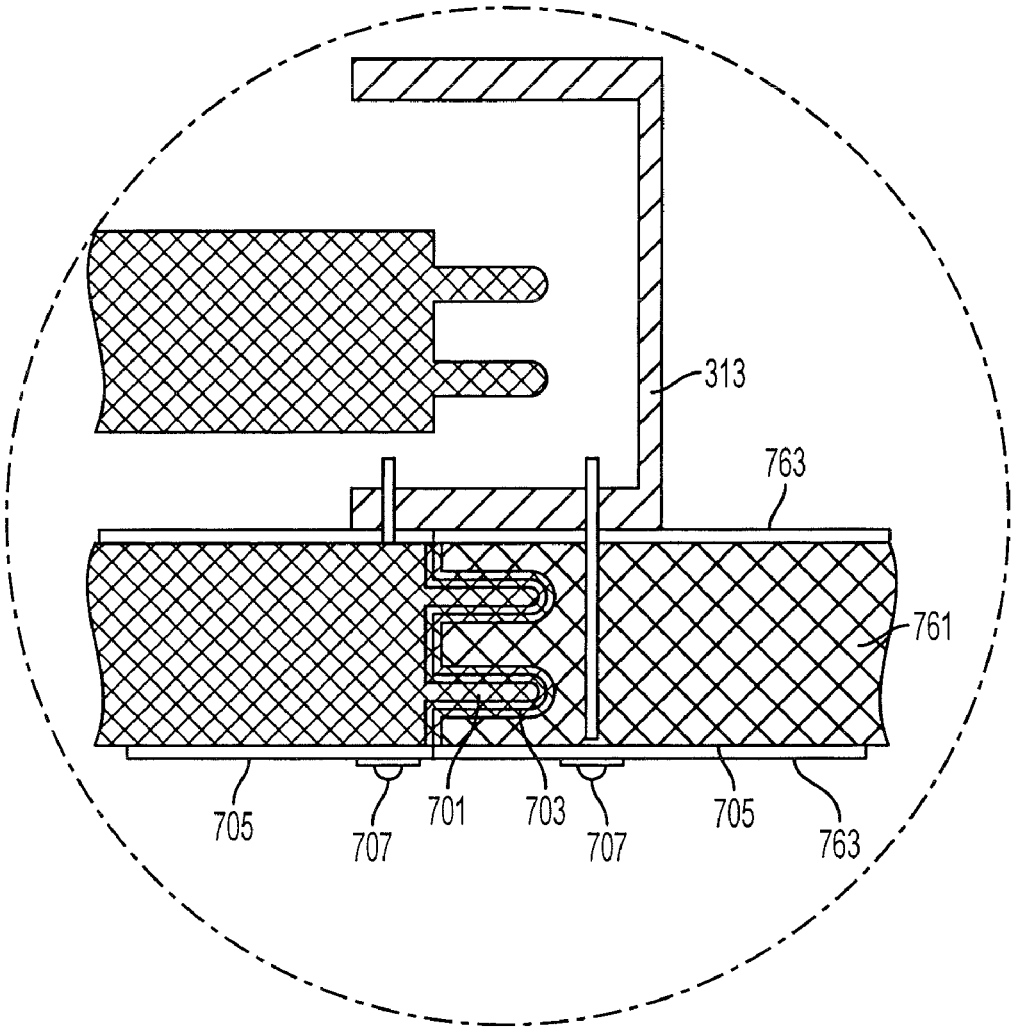
Figure 8A:
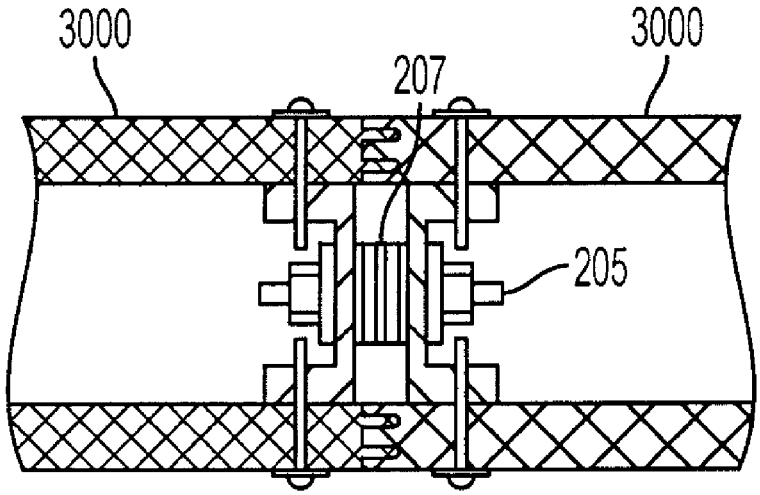
FIG. 8 shows a detail view of an embodiment of a connection between wall panels of FIG. 7.
Figure 8B:
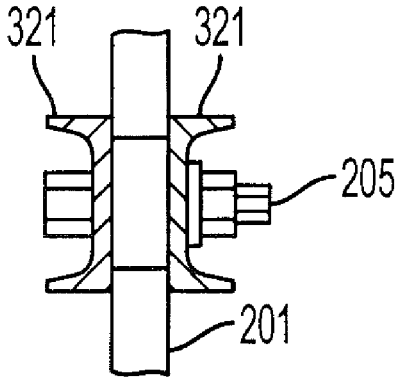

In the embodiment of FIGS. 6-8, adjacent wall panels (300) are connected together via a tongue (701) and groove (703) arrangement. Further, in the embodiment of FIGS. 6-8 each wall panel (300) actually comprises four component panels (705) arranged on the frame (311), two on each side. Each component panel (705) comprises insulation (761) sandwiched between two cover sheets (763) forming yet another sandwich construction. The individual component panels (705) are then attached together using a similar tongue (701) and groove (703) arrangement and bolted with bolts (707) or similar structures to a central support (313) of the flame. This attachment is shown in FIG. 7B.

In the embodiment of FIGS. 1-5, an alternative arrangement is used to attach individual wall panels (300) together. In this embodiment, the wall panels (300) are fitted with containment strips, filler sections, clamps, or other structures (715) which allow each of the wall panels (300) to be joined together with neighboring wall panels (300) using a section filler strip (717) or other sealing mechanism. Regardless of which method is used, it results in what is effectively a single perimeter wall formed of the wall panels (300) or (3000) when the wall panels (300) or (3000) are connected together.

Figure 5:
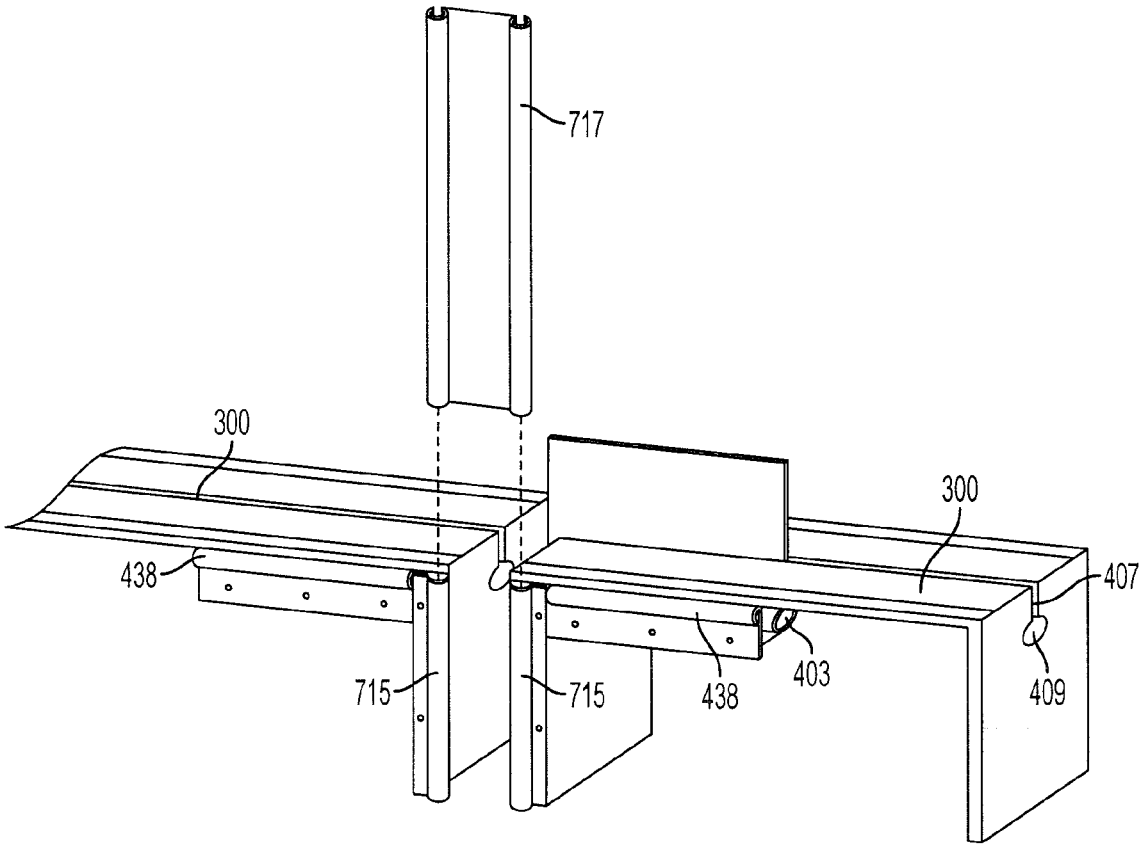
FIG. 5 shows a perspective view of the connection between the panel of FIG. 4 and the fabric of the air supported structure and the connections between adjacent panels.

The embodiments of FIGS. 1-8 also show different methodologies for attaching the membrane (101) to the wall panels (300). In the embodiment of FIGS. 1 and 3-5, the top of each of the wall panels (300) is designed to allow another common rod (401) to be used for joining the wall panels (300) to the air supported structure's upper membrane walls and roof by having a fold (403) in the bottom end of the membrane (101) which is fed into a narrow groove (407) having a bulbous lower portion. The rod (401) is then threaded into the fold (403) passing through the bulbous section (409) and once in place the rod (401) and fold (403) combination cannot pass back through the groove (407). This is shown in FIG. 5 with the box beam (323) removed for clarity. This design also provides for two points of support between the wall panels (300) on each linear side of the structure (100) to prevent rotation of the wall panels (300) relative to each other.

In the embodiment of FIG. 2, a flap of fabric from the membrane (101) is simply captured by a trap bolt (411) and pinched between the trap bolt (411) and the upper box beam (323) of the wall panels (3000). Once the wall panels (300) or (3000) are attached to the anchorages (201) and the upper membrane (101) of the air supported structure (100), each of the wall panels (300) is in place.

In an embodiment there may also be attached toward the upper end of each wall panel (300) or (3000) a containment strip (438) which serves to provide a quick connection to a fabric wall rain flap (207) included with the inflatable membrane (101) of the air supported structure (100) and which is connected to the wall panel's (300) or (3000) upper end. This rain flap (207) can help weatherproof the connection between the wall panel (300) or (3000) and the membrane (101).

An air seal flap (501) may also be attached toward the base and generally on the interior of each wall panel (300) or (3000), as shown in FIG. 2 which is then also sealed to the foundation (105) to serve to seal the hinge area to the ground and prevent unintended air loss through the hinged connection.

Figure 2A:
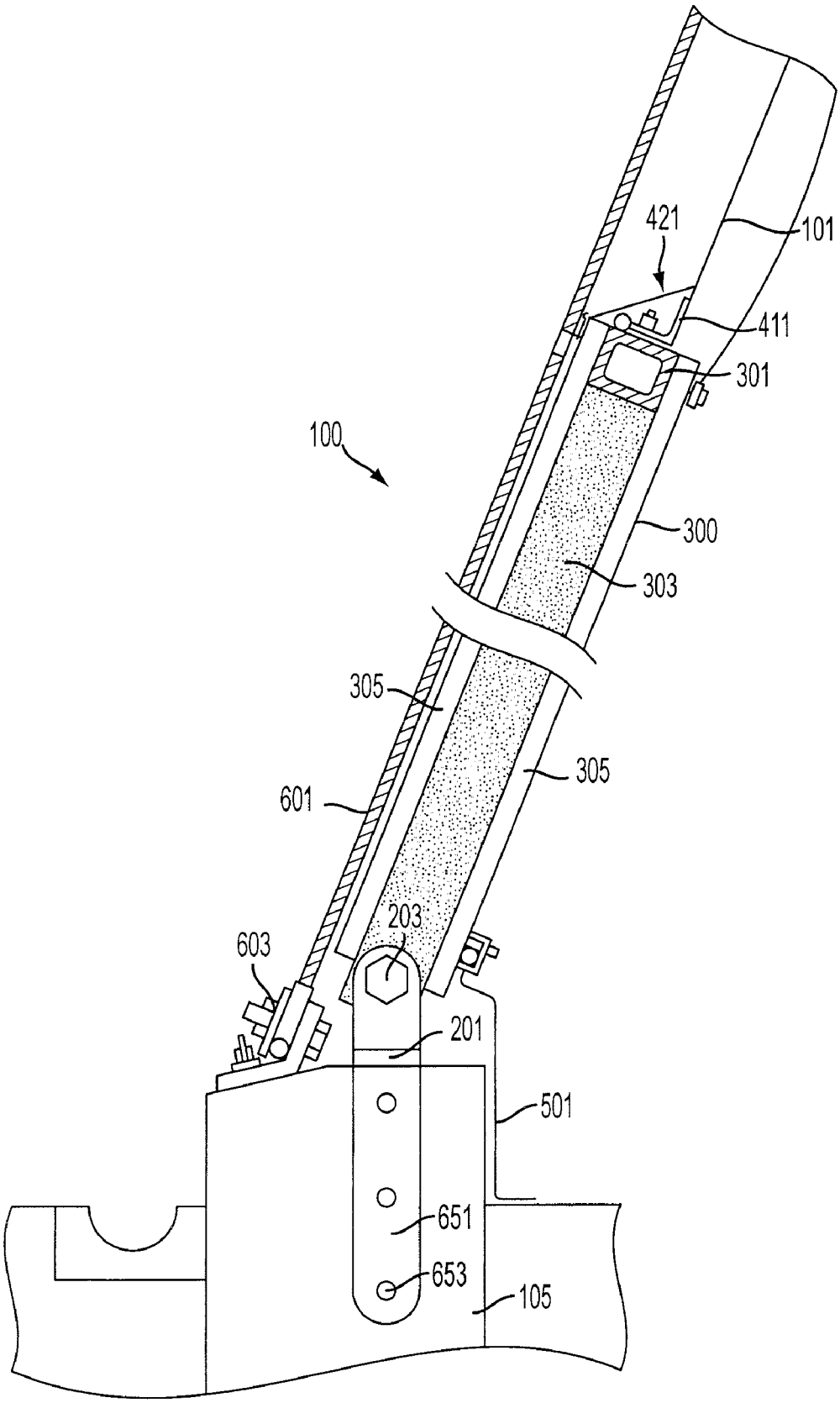
FIG. 2A shows a cross sectional view of the embodiment of FIG. 1A
Figure 2B:
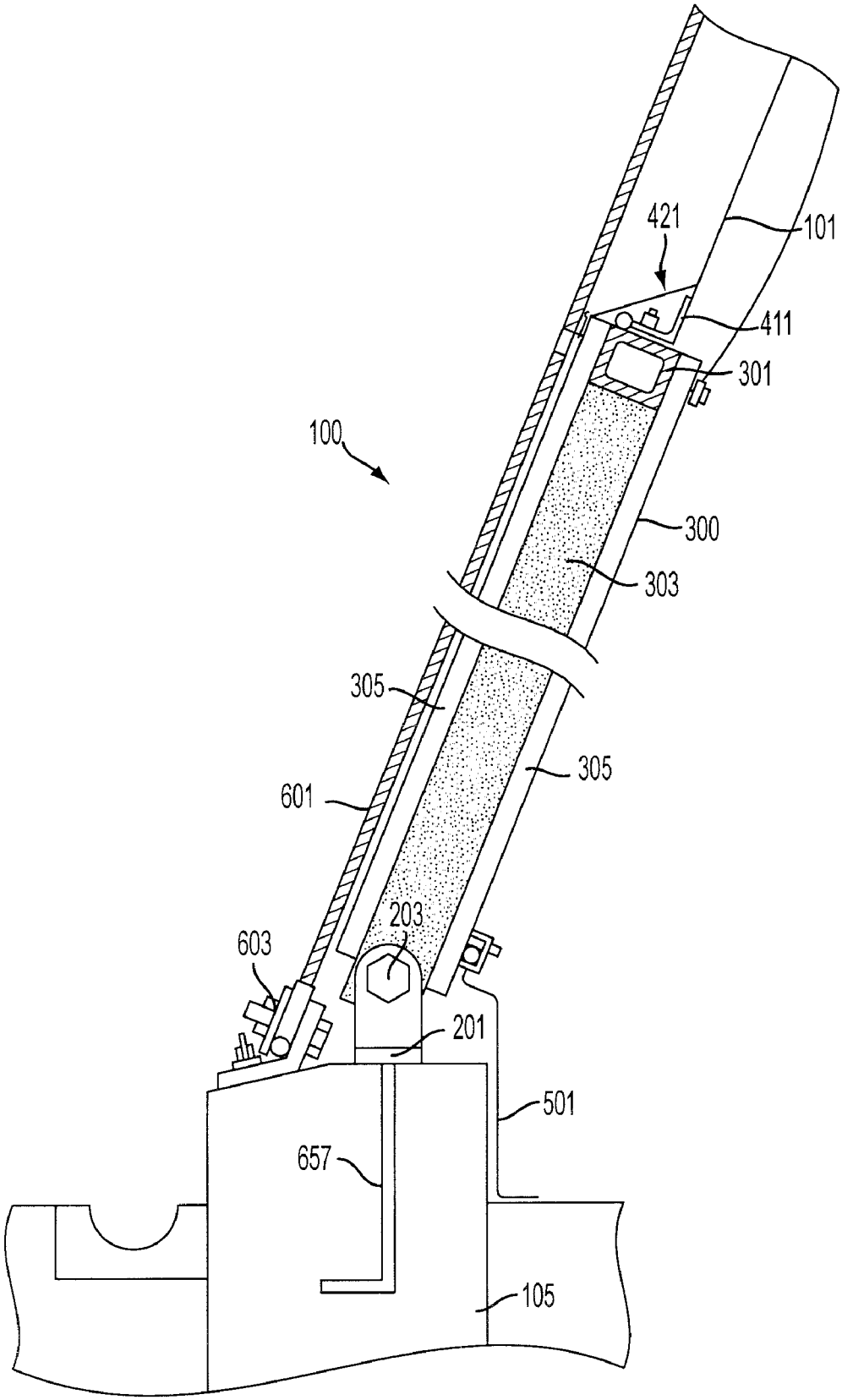
FIG. 2B shows a cross sectional view of FIG. 1B. Both FIGS show the hinged anchor connecting the panel to the ground and the connection of the panel to the fabric of the structure.
Figure 3:
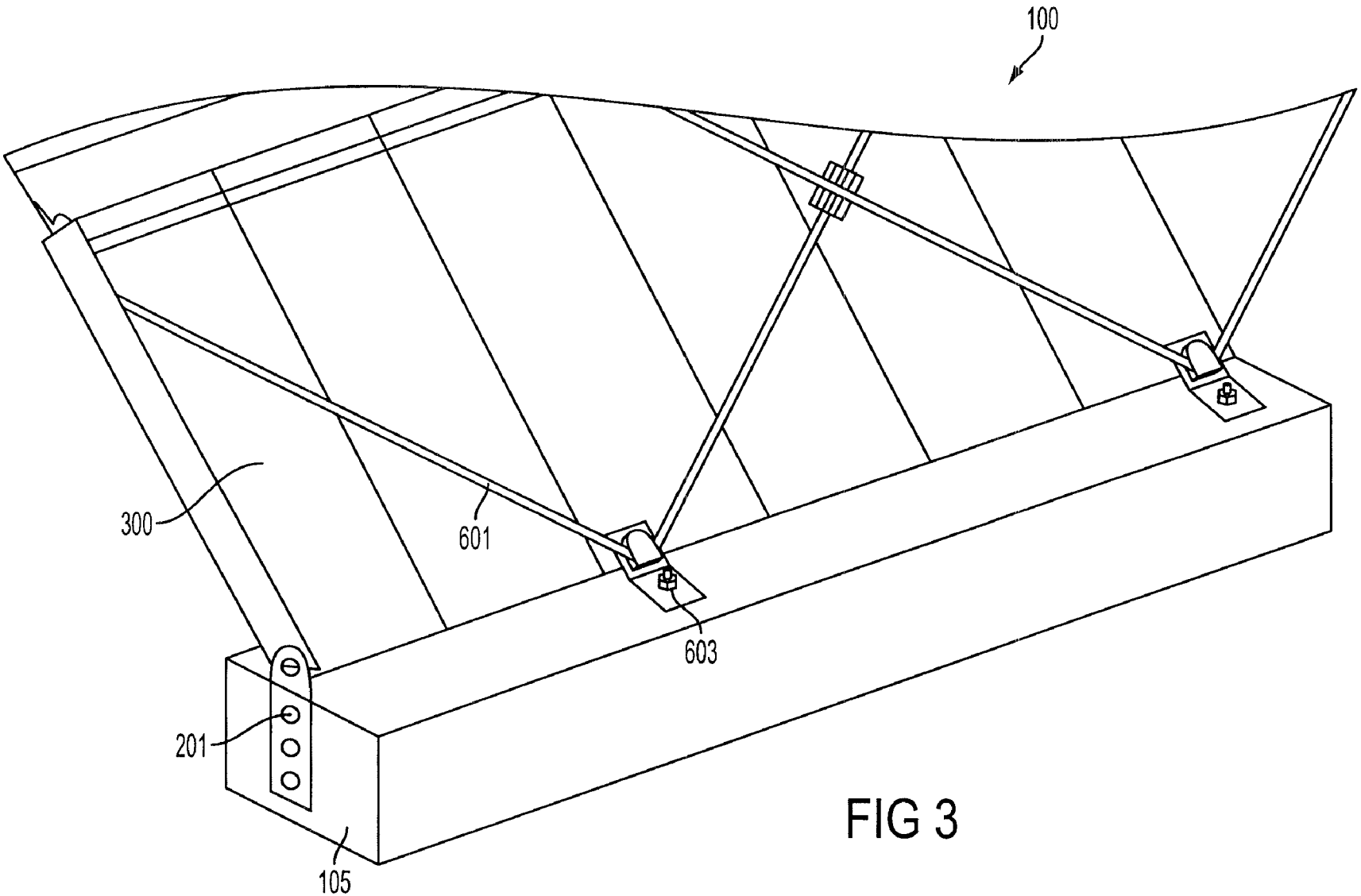
FIG. 3 shows a perspective view of another embodiment including of a cable net support structure in use with an air supported structure having hinged perimeter wall panels.

As shown in FIGS. 2 and 3 as well as 12 through 15, the structure (100) may include further reinforcement by the inclusion of cable nets (601) which are anchored at cable anchorage (603) to the foundation (105) and extend generally up and over the entire structure (100). These can provide for additional rigidity, as well as making the structure (100) able to hold a greater air pressure.

The exterior cable nets (601) may encapsulate the entire upper membranous envelope roof and walls (101) and the lower perimeter wall (103) allowing the stresses in the total structure to transfer their loads to the cable anchorage (603). Each of the panels (300) and (3000) can allow the lift load caused by inflation and wind loading on the resultant structure (100) to carry directly down to the anchorage (201) in the foundation (105) as well.

Figure 1B:
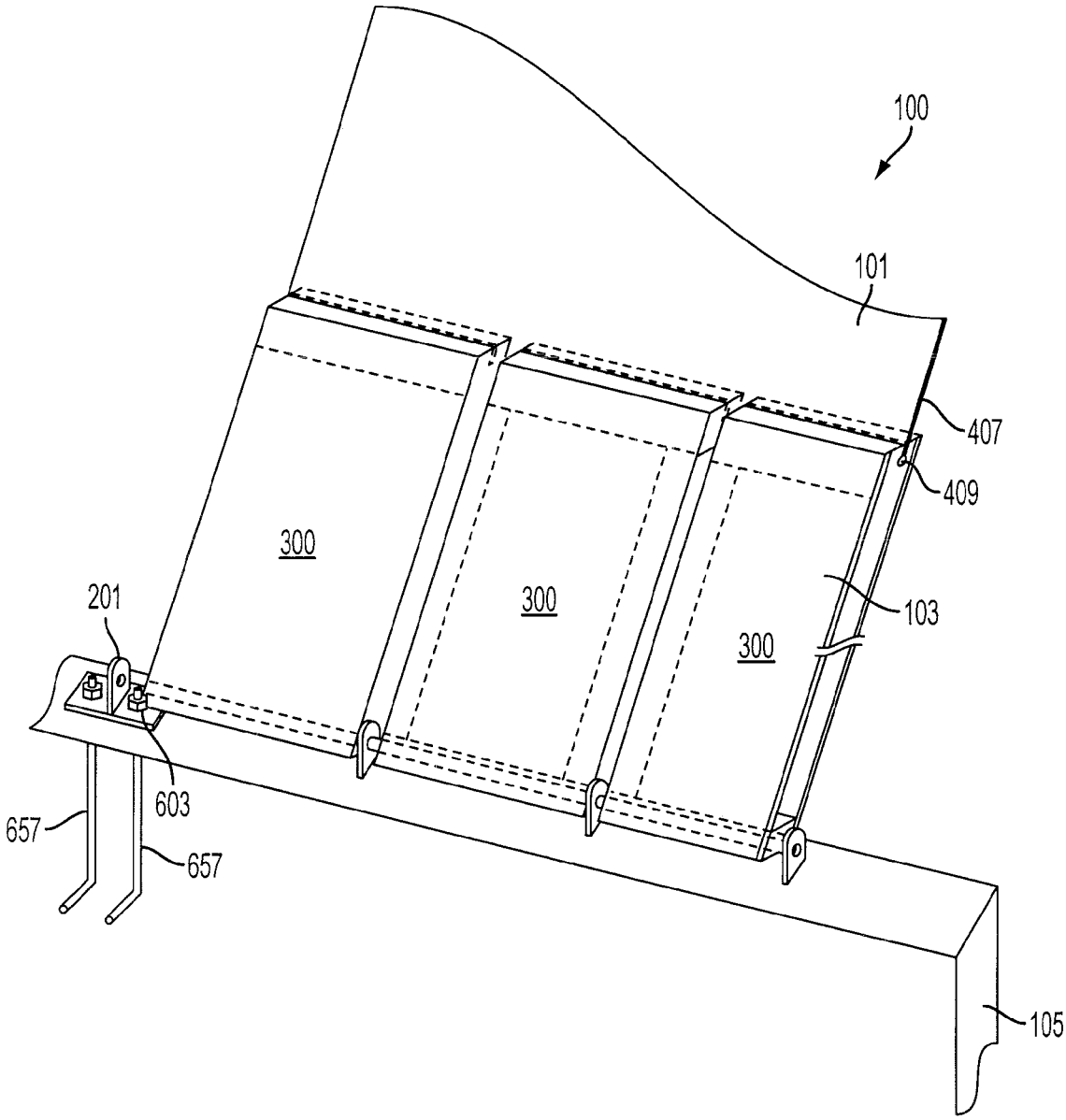
Figure 9:
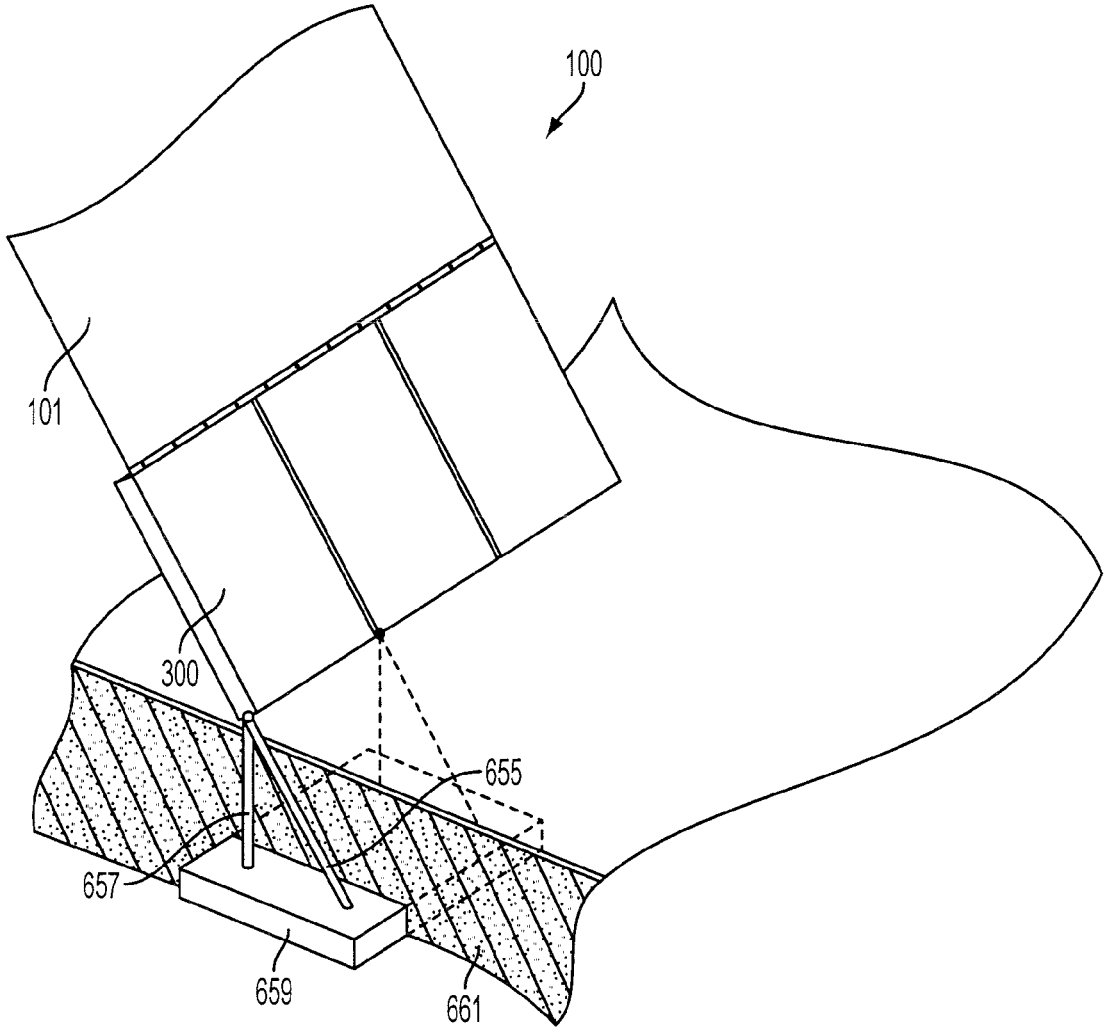
FIG. 9 shows a perspective view of a second embodiment of an air supported structure including perimeter wall panels utilizing a different foundational connection.
Figure 10:
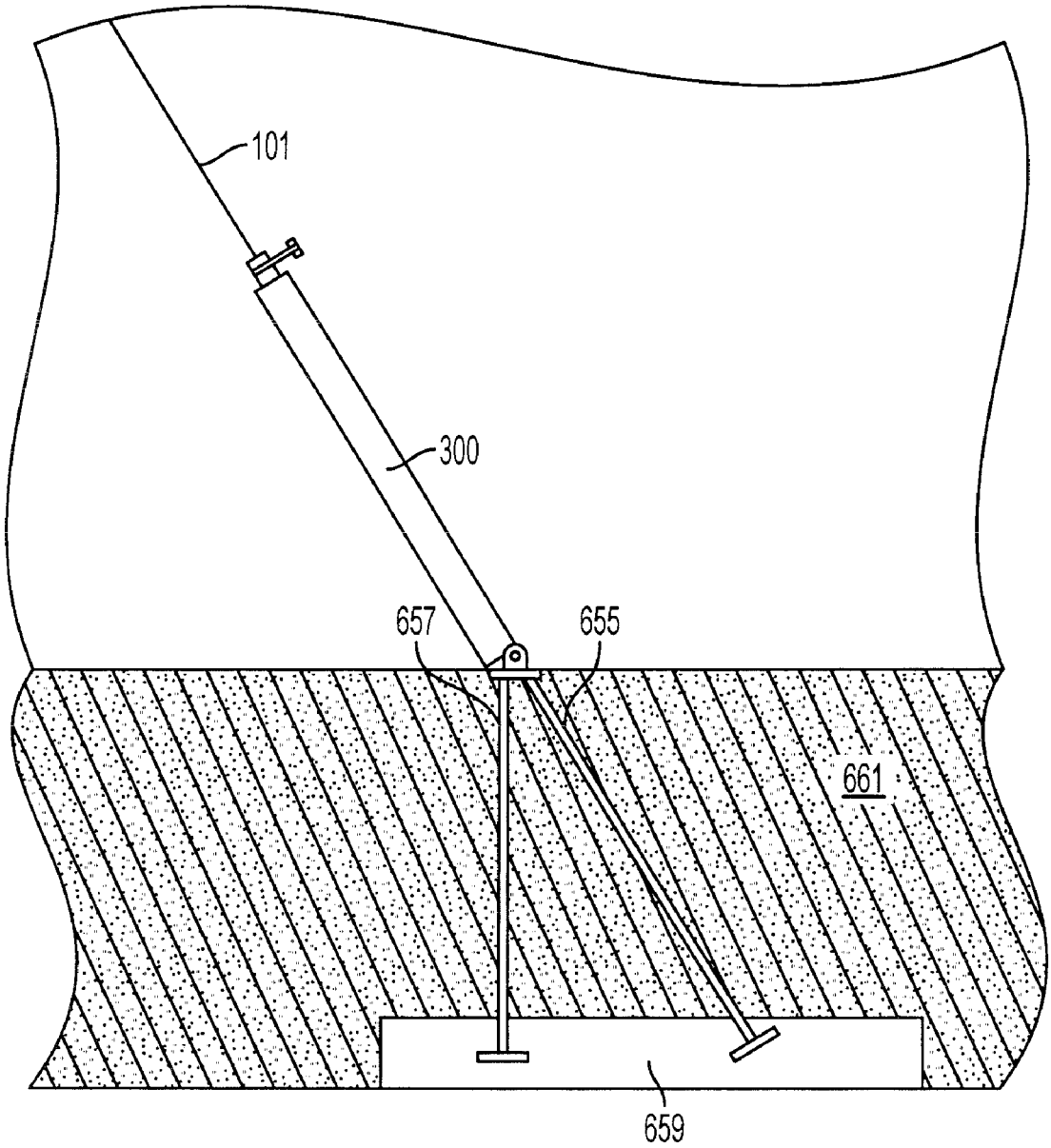
FIG. 10 shows a cross-sectional view of the embodiment of FIG. 9.

FIGS. 1B and 2B as well as 8 and 9 provide for alternative designs for anchorage (201). In FIGS. 1B and 2B, the anchorage (201) is attached using a bent rod (657). In the case of FIGS. 8 and 9 the anchorage (2001) comprises not a single anchor extension (651) with pegs (653) as shown in the anchorage (201) of FIGS. 1A and 2A, but comprises two legs (655) and (657) of a triangular beam which connect to a buried holding block (659). The holding block (659) is buried in the earth (661). This design is preferred if the resultant structure should have no visible foundation or if the earth (661) is unsuitable for a more permanent foundation (105).

To assemble an air supported structure (100) that uses hinged wall panels (300) or (3000), the panels (300) or (3000) will generally be laid out and assembled in a flat position on the foundation (105) for the air supported structure (100). Attaching the wall panels (300) both to the membrane (101) and the foundation (105) will occur with the structure (100) deflated. The structure (100) may then be inflated which will naturally lift the wall panels (300) to their raised position as shown in FIG. 11 as the pressure inside the structure (100) pushes them upright.

The wall panels (300) forming the corner (300A) of the perimeter walls may be difficult to have lifted during inflation of the structure as their shape does not allow them to rise from a flat position to their final assembled position without interaction with other wall panels (300B). In an embodiment, the corners (300A) may therefore be placed flat and not connected to the remaining perimeter wall (103) until the other perimeter wall panels (300B) have been raised to their final position by a crane or other lift device. The remaining panels (300B) then may be held in position while the coiner panels (300A) are connected. Then the membrane (101) can be inflated. This, however, can be difficult, particularly on large structures, due to the weight of the combined wall panel structures (300B).

Figure 11:
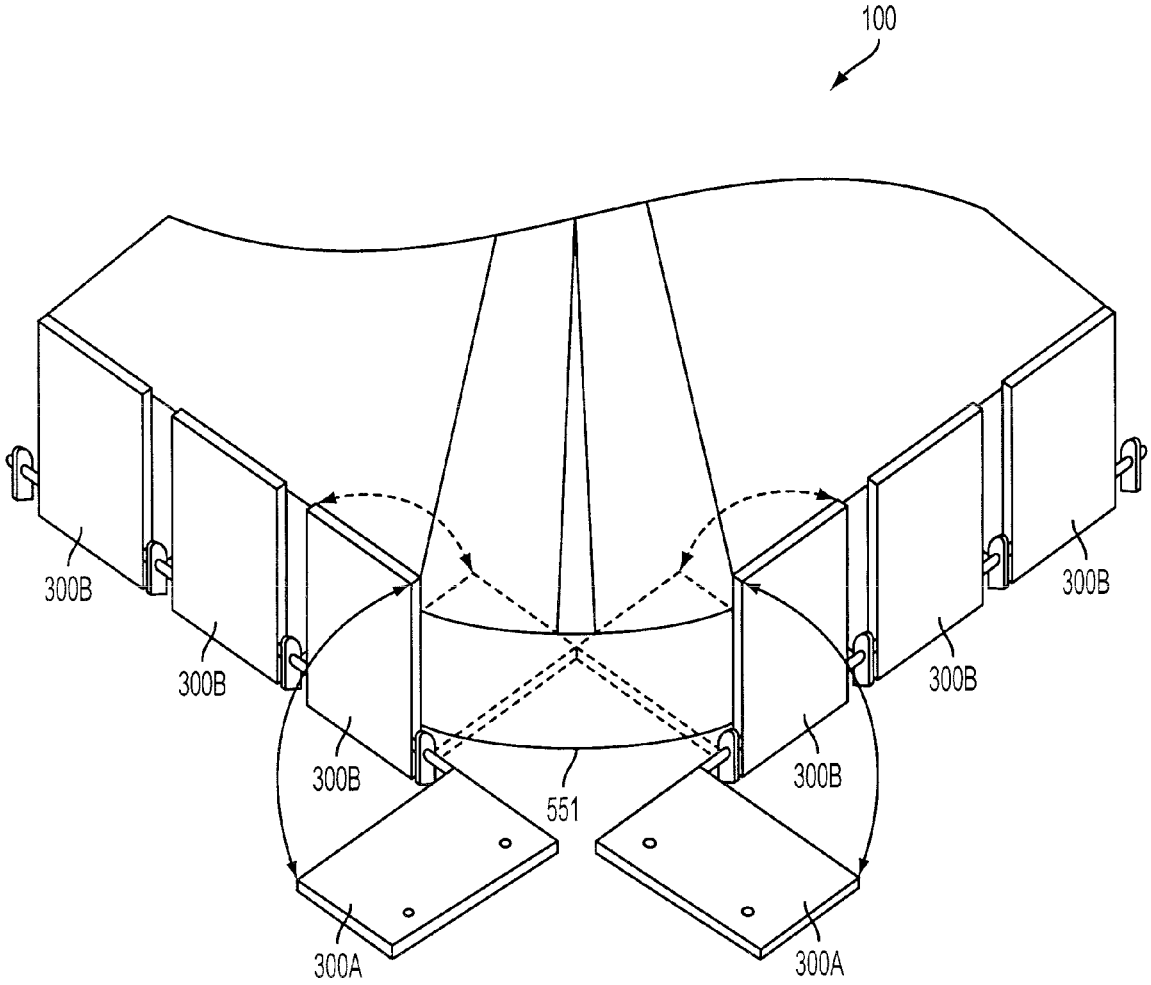
FIG. 11 shows a perspective view of a structure with hinged panels, indicating how corner panels can be positioned.

Instead, as shown in FIG. 11, the corners of the structure (100) may be initially formed of a fabric barrier (551), and the structure (100) may then be inflated without the corner wall panels (300A) attached and with them laying flat exterior to the structure (100). The structure's (100) resultant air pressure serves to lift the other panels (300B) from their flat (dashed line) position and raise them to their erect position with the barrier (551) sealing the corners. Once all the side perimeter panels (300B) have been lifted from the flat ground assembly position to their fully erected position, corner panels (300A) are lifted in place and connected to those air supported wall panels (300B) already in place, as shown in FIG. 11. The fabric corners (551) may then be removed, if necessary or desired. Once the corner panels (300A) are attached, the perimeter wall (103) is complete and also relatively self supporting.

Once the structure is inflated and erect, any of the wall panels (300) or (3000) can be removed and the space between the wall panels (300) or (3000) can be spaced to meet the door entrances as required for the resultant structure. Alternatively, special panels may have been originally included which include doors or similar structures. The fabric connecting the doors to the wall panels (300) or (3000) may be similar to that of the wall panel (300) containment strips (717).

The resultant air supported structure (100) therefore provides an upper flexible membrane (101) roof and walls to be assembled to a lower rigid perimeter wall (103). Once the inflation air system pumps air into the structure, the total fabric envelope and lower wall panels (300) or (3000) will automatically lift in place under the cable nets (601) and once fully inflated, the lift loads will be transferred from both the air supported membranous envelope (100) and wall panels (300) or (3000) into the safety cable nets (601). The wall panels (300) or (3000) provide the security and resistance to vandalism and damage caused by intentional vandalism by providing for a more rigid and stronger design to the lower portion of the structure (100).

FIGS. 12-15 provide for two alternative embodiments of providing for wall panels at the lower portion of an inflatable structure (100). In both embodiments, the wall panels (800) and (900) are not hinged to the foundation (105), but are instead rigidly connected to the foundation (105), or to the earth (661) under the air-supported structure (100) if a foundation (105) is not used. In the embodiments of FIGS. 12 through 15 the panels (800) and (900) are not hinged to the ground, but are instead placed by being buried or cast into the foundation (105) or earth (661) or otherwise rigidly attached to the building's foundation (105) such as by angle connectors (901). This design can provide for a stronger more rigid connection to the foundation (105) and elimination of the hinge structure. However, at the same time this embodiment will generally need to be erected at the time the foundation (105) is constructed, and wall panels (800) and (900) are generally not as easily removed and replaced as wall panels (300) or (3000). However, connection of the wall panels (800) or (900) to the membrane (101) is often simpler. In the embodiment of FIG. 8, the membrane (101) of the air supported structure (100) is connected outside the perimeter wall (103) via a strap (803) or other structure which provides for transfer of wind load without placing undue torque on the wall panel (800), which as opposed to the hinged embodiments, lacks the ability to rotate relative to the ground. A sealing flap (805) is then included for integrity of the structure (100) between the membrane (101) and the wall panel (800).

Figure 12:
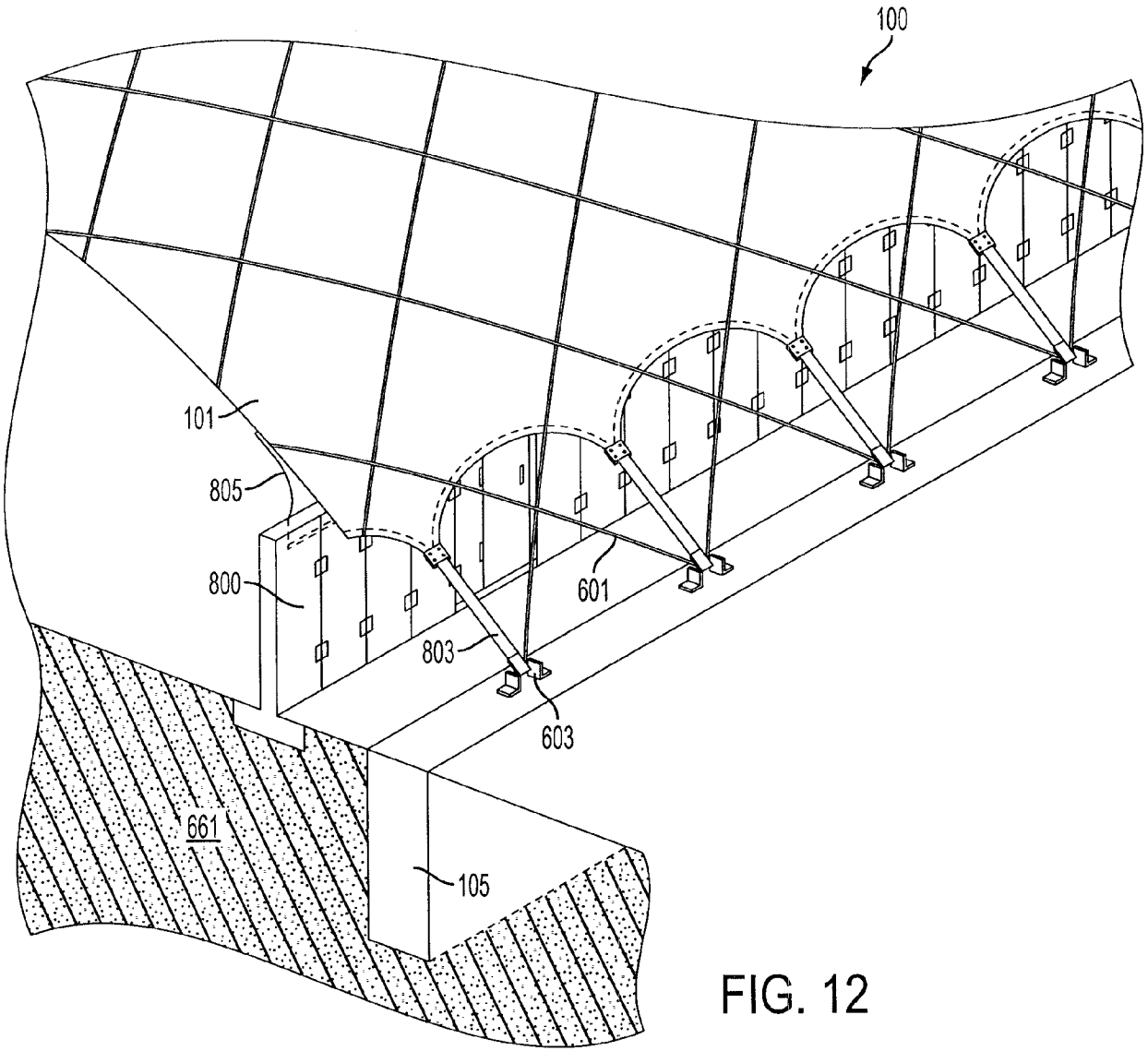
FIG. 12 shows a perspective view of another embodiment of an air supported structure utilizing wall panels maintained in a rigid upright position.
Figure 13:
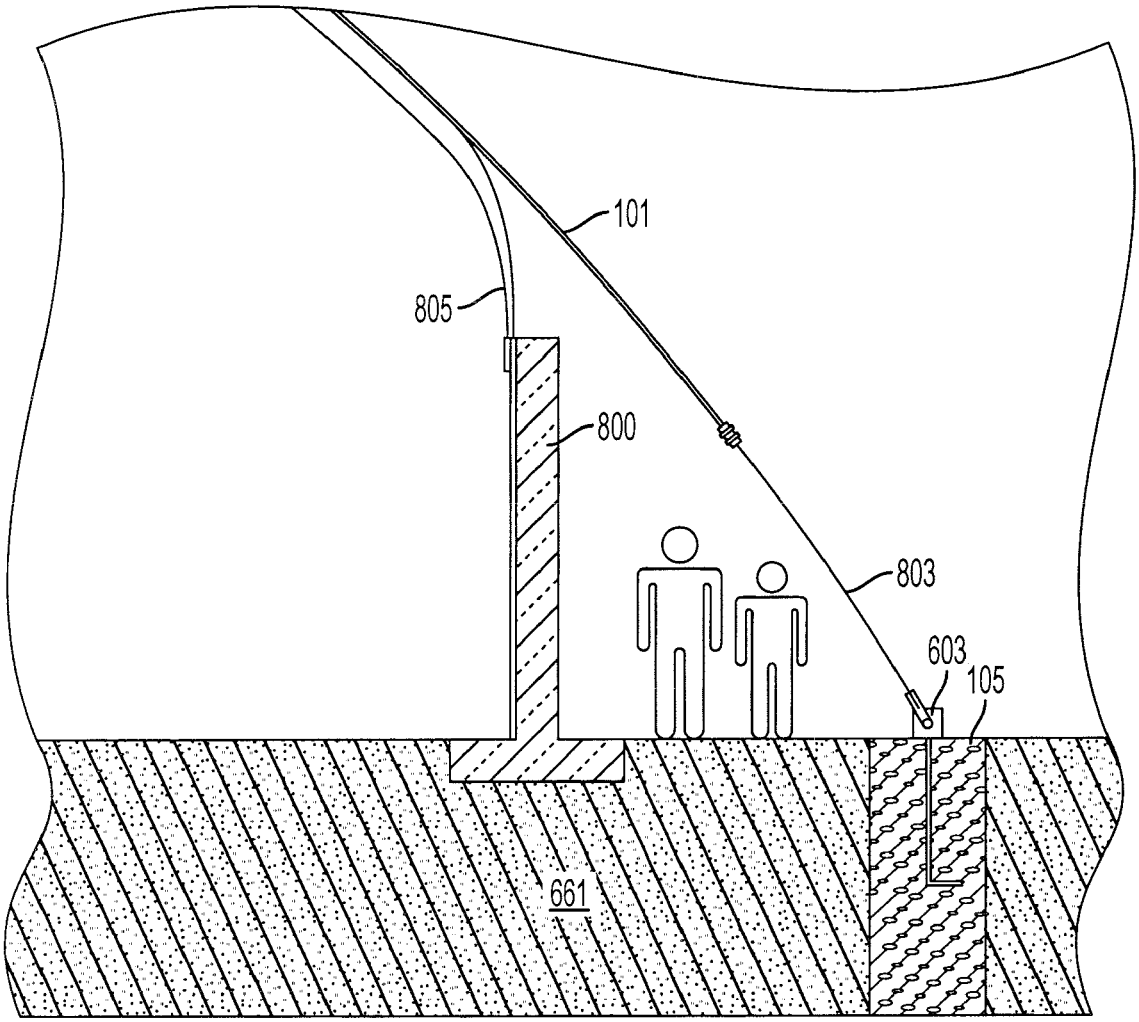
FIG. 13 shows a cross-sectional view of the embodiment of FIG. 12.
Figure 14:
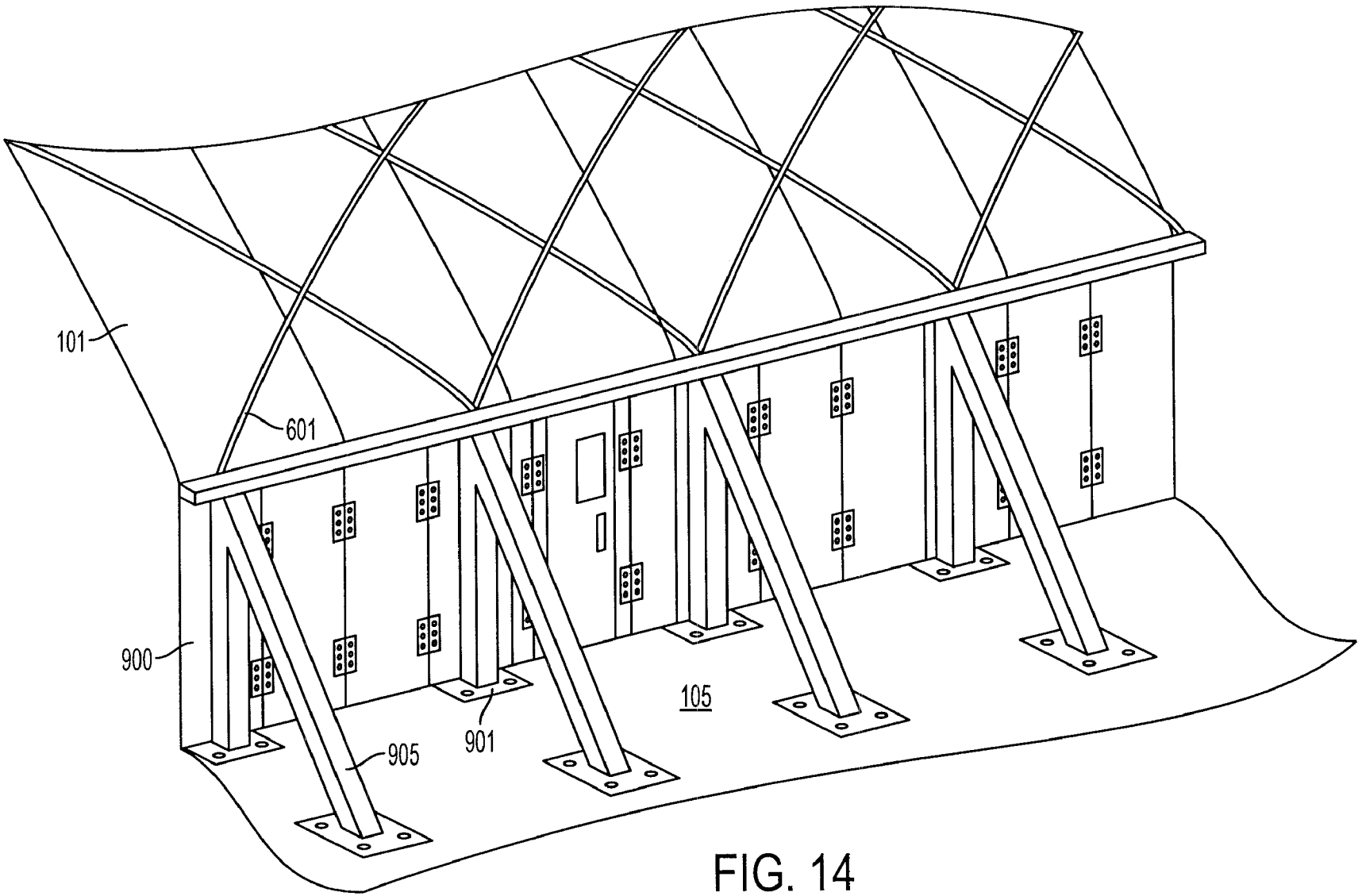
FIG. 14 shows a perspective view of another embodiment of an air supported structure utilizing wall panels maintained in a rigid upright position.
Figure 15A:
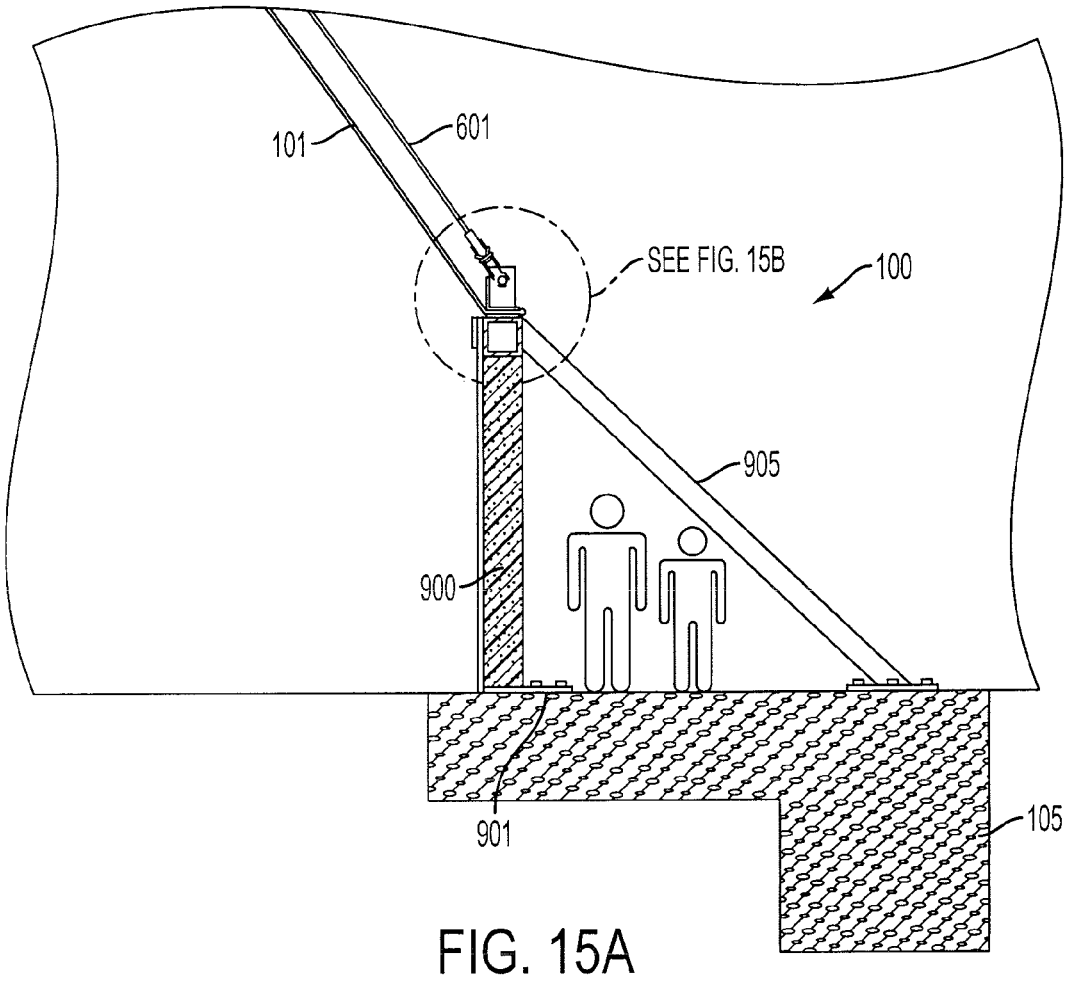
FIG. 15 shows a cross-sectional and detail view of the embodiment of FIG. 14.
Figure 15B:
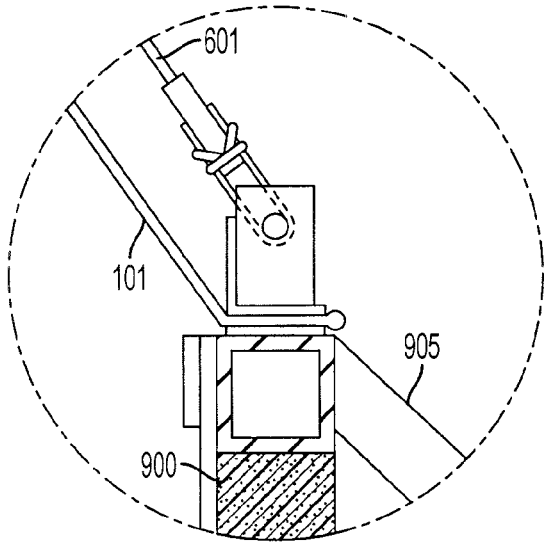
Figure 16:
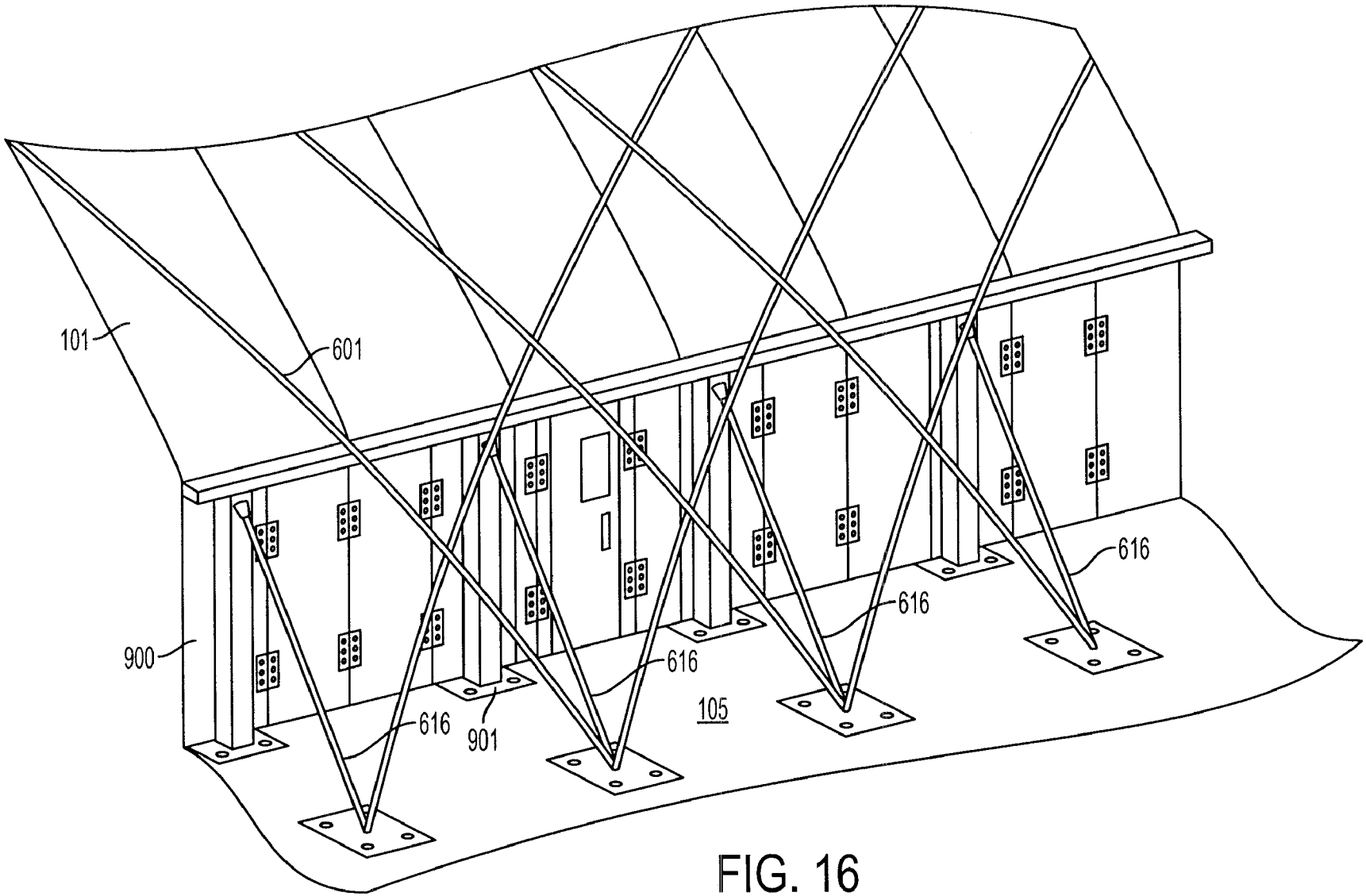
FIG. 16 shows a perspective view of another embodiment of an air supported structure utilizing wall panels which utilizes the cable net for support.

The embodiment of FIGS. 14 and 15 is generally similar to the embodiment of FIGS. 12 and 13 but is designed to allow the wall panels (900) to absorb still more load. In particular, in this embodiment the wall panels (900) may again be cast into the foundation (105) (or as shown here may be attached to it via rigid connection plates (901)). However, in this embodiment, the wall panels (900) are provided with rigid structure support members (905) and the membrane (101) of the air structure are only shown connected to the wall panels (900) directly. This structure (100) allows for load to be transferred to the wall panels (900), which, while unable to rotate as was the case in the embodiments of FIGS. 1-11, are rigidly supported in place by the structural support members (905) to inhibit damage to the wall panels (900) from applied torque. FIG. 16 provides for yet another embodiment. In this embodiment, however, the structural support members are replaced by tensioned cables (616) which are connected to the foundation (105) to provide for support.

In all embodiments, but specifically those embodiments of FIGS. 12-15, the perimeter wall panels can serve a further purpose. In particular, they can serve to provide an emergency safety space around the perimeter of the structure (100). In the event the structure (100) was to suffer a deflation resulting in the membrane (101) sinking into what is normally the interior of the structure (100), the perimeter wall panel will generally serve to create a space between itself and the deflated membrane due to its upright structure and the fact that it will generally not collapse even upon deflation of the structure (100). In effect, there will be an open space adjacent and interior the perimeter wall panels allowing for emergency organizing space and inhibiting panic by allowing people to have space to orderly reach emergency exits.

In another embodiment, the perimeter wall panels may be combined with a series of structural constructs such as, but not limited to, I-beam or tubing poles with cables, rope, or fabric straps spanning between the poles and around the perimeter. These constructs can be attached to the perimeter wall panels to provide for a larger emergency safety space than would be permitted by the perimeter wall panels themselves. Such constructs may be on top of the perimeter wall panels, or may be inside the perimeter wall panels allowing for the creation of a "walkway" around the interior perimeter in the event of deflation.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A wall panel for use with an inflatable structure, the wall panel comprising;

a frame;

two exterior panels attached to said frame and spaced from each other;

an insulative inner section located between two said exterior panels;

a first connector, said first connector allowing said wall panel to be connected to the earth in a hinged fashion;

a second connector, said second connector allowing said wall panel to be connected to a membrane;

wherein, a plurality of said wall panels are used to form a perimeter wall on the lower portion of an air supported structure, said membrane forming a roof of said air supported structure; and wherein said plurality of said panels utilize a common rod for said hinged connection.

2. The panel of claim 1 wherein said first connector is designed to attach to the earth via a foundation.

3. The panel of claim 1 wherein each of said exterior panels comprises a component panel.

4. The panel of claim 1 wherein said structure further includes exterior cable nets encapsulating said structure.

5. An inflatable structure comprising:

a roof comprising a membrane; and a perimeter wall comprised of a plurality of perimeter wall panels, each of said panels comprising:

a frame;

two exterior panels attached to said frame and spaced from each other;

an insulative inner section located between two said exterior panels;

a first connector, said first connector allowing said wall panel to be connected to the earth in a hinged fashion; and a second connector, said second connector allowing said wall panel to be connected to a membrane;

wherein, said roof is attached to an upper surface of said perimeter wall; and wherein the portion of said plurality of perimeter wall panels which form a side of said structure utilize a common rod for said hinged connection.

6. The structure of claim 5 further comprising a foundation, wherein said first connector is designed to attach to said foundation.

7. The structure of claim 5 wherein said structure further includes exterior cable nets encapsulating said structure.

8. The structure of claim 5 wherein said perimeter wall provides for emergency space internal the perimeter of said inflatable structure in the event said inflatable structure deflates.

9. A method of constructing an inflatable structure, the method comprising:

providing a membrane;

providing a plurality of perimeter wall panels, each of said panels comprising:

a frame;

two exterior panels attached to said frame and spaced from each other;

an insulative inner section located between two said exterior panels;

a first connector, said first connector allowing said wall panel to be connected to the earth in a hinged fashion; and a second connector, said second connector allowing said wall panel to be connected to a membrane;

arranging said plurality of perimeter wall panels on the earth so that one of said exterior panels is adjacent to and generally tangential to the earth;

connecting the portion of said plurality of perimeter wall panels which form a side of said structure to a common rod for said hinged connection;

attaching said membrane to an upper surface of each of said perimeter wall panels so as to form an at least partially enclosed space;

increasing the air pressure within said partially enclosed space so as to cause said membrane to lift into the air;

as said membrane lifts, having said membrane pull said plurality of perimeter wall panels into an upright position where said one of said exterior wall panels is no longer generally tangential to the surface of the earth; and securing said plurality of perimeter wall panels in said upright position.

* * * * *